US011999537B2

(12) United States Patent
McNamara et al.

(10) Patent No.: US 11,999,537 B2
(45) Date of Patent: Jun. 4, 2024

(54) POPPET LID

(71) Applicant: Helen of Troy Limited, St. Michael (BB)

(72) Inventors: Conor McNamara, Montclair, NJ (US); Martin Mutch, Bend, OR (US); Jeff Burga, Bend, OR (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 17/583,320

(22) Filed: Jan. 25, 2022

(65) Prior Publication Data

US 2023/0234759 A1 Jul. 27, 2023

(51) Int. Cl.

| | |
|---|---|
| ***B65D 47/24*** | (2006.01) |
| ***A45F 3/18*** | (2006.01) |
| ***B65D 51/16*** | (2006.01) |
| ***B65D 53/02*** | (2006.01) |

(52) U.S. Cl.

CPC ..... *B65D 47/248* (2013.01); *A45F 3/18* (2013.01); *B65D 51/1622* (2013.01); *B65D 53/02* (2013.01)

(58) Field of Classification Search

CPC ... B65D 47/248; B65D 47/2025; B65D 41/04
USPC ..... 220/254.9; 215/307
See application file for complete search history.

(56) References Cited

U.S. PATENT DOCUMENTS

| | | | | |
|---|---|---|---|---|
| 3,174,641 | A | 3/1965 | Kitterman | |
| 3,628,704 | A | 12/1971 | Corsette | |
| 3,717,276 | A | 2/1973 | Luczak | |
| 5,328,063 | A | 7/1994 | Beck | |
| 5,620,117 | A * | 4/1997 | Bieze | B65D 47/248 222/484 |
| 5,651,471 | A * | 7/1997 | Green | B65D 47/243 222/545 |
| 5,927,565 | A * | 7/1999 | Paczonay | B65D 47/243 222/525 |
| 5,971,225 | A | 10/1999 | Kapsa | |
| 7,204,382 | B2 | 4/2007 | Cezeaux | |
| 7,328,820 | B2 * | 2/2008 | Young | B65D 47/0838 220/717 |
| 8,875,927 | B2 | 11/2014 | Pohlman | |
| 9,060,592 | B2 * | 6/2015 | Brosius | B65D 47/06 |
| 2003/0034364 | A1 * | 2/2003 | Mugge | B65D 47/248 222/518 |

(Continued)

*Primary Examiner* — Ernesto A Grano
*Assistant Examiner* — Symren K Sanghera
(74) *Attorney, Agent, or Firm* — Rankin, Hill & Clark LLP

(57) ABSTRACT

A lid for a drinking container includes a lid body, a poppet mouthpiece and a resilient sealing member. The lid body defines a longitudinal axis and includes an outer surface with a vent hole. The mouthpiece seals against a first inner surface of the lid body via an annular seal ring. The mouthpiece is movable between a closed position and an open position to allow fluid inside the container to flow through the mouthpiece. The sealing member is fitted on the lid body to sealingly engage the lid body to an open end of the container. The sealing member includes an annular flange sealingly engaging a second inner surface of the lid body. The flange includes a groove that defines a location on the lid where ambient air flowing into the vent hole can enter a container interior as fluid flows out of the container through the mouthpiece.

18 Claims, 8 Drawing Sheets

(56) References Cited

U.S. PATENT DOCUMENTS

| | | | | |
|---|---|---|---|---|
| 2012/0024854 | A1* | 2/2012 | Wahl | B65D 47/248 220/262 |
| 2015/0274385 | A1* | 10/2015 | Zoppas | B65D 47/248 215/329 |
| 2016/0059255 | A1* | 3/2016 | Brannon | B65D 41/04 215/44 |
| 2017/0029177 | A1* | 2/2017 | Holroyd | G01F 11/262 |
| 2019/0352059 | A1* | 11/2019 | Mutch | B65D 47/068 |
| 2020/0270030 | A1* | 8/2020 | Kim | B65D 51/1605 |
| 2021/0122536 | A1* | 4/2021 | Covi | B67D 1/0832 |
| 2021/0229976 | A1* | 7/2021 | Petrangeli | B67D 7/0294 |
| 2022/0348385 | A1* | 11/2022 | Knutsen | B65D 75/5883 |

* cited by examiner

POPPET LID

BACKGROUND

The present disclosure relates generally to water containers commonly used by cyclists for rehydration, and more specifically to a poppet lid for such water containers.

Water containers are commonly used by athletes and others to hold and dispense fluids or liquids, such as water and sports drinks. Water containers commonly include a body, a lid or cap, and a mouthpiece that is movable relative to the lid between open and closed positions. In the open position, fluid can be dispensed from the container, and in the closed position, fluid is inhibited from being dispensed from the container.

Water containers mouthpieces are frequently in the form of poppet valves that can be slid between open and closed positions. Such poppet valves usually include an engagement portion that facilitates engagement by the user to facilitate opening the mouthpiece. Further, when fluid is withdrawn from the container, through the mouthpiece, a negative pressure may be created within the container, thus making it more difficult to further withdraw liquid. To address this problem, various types of vents have been used to allow ambient air into the container and equalize the pressure between the inside of the container and the outside atmosphere.

SUMMARY

According to one aspect, a lid for an associated drinking container comprises a lid body, a poppet mouthpiece and a resilient sealing member. The lid body defines a longitudinal axis and includes an outer surface with a vent hole. The mouthpiece seals against a first inner surface of the lid body via at least one annular seal ring provided on the mouthpiece. The mouthpiece is movable along the longitudinal axis between a closed position and an open position relative to the lid body. When in the open position the mouthpiece allows fluid from inside the associated drinking container to flow through the mouthpiece. The sealing member is fitted on the lid body and adapted to sealingly engage the lid body to an open end of the associated drinking container. The sealing member includes an annular flange sealingly engaging a second inner surface of the lid body. The flange includes at least one groove extended in a direction substantially parallel to the longitudinal axis. The at least one groove defines a predetermined location on the lid where ambient air flowing into the vent hole can enter an interior of the associated drinking container as fluid flows out of the associated drinking container through the mouthpiece in the open position.

According to another aspect, a lid for an associated drinking container comprises a lid body, a mouthpiece and a resilient sealing member. The lid body defines a longitudinal axis, and includes an upper wall with a vent hole, an outer side wall extending downwardly from the upper wall, and an inner surface. The mouthpiece is movable between a closed position and an open position relative to the lid body. When in the open position the mouthpiece allows fluid from inside the associated drinking container to flow through the mouthpiece. The sealing member is fitted on the lid body. The sealing member is adapted to sealingly engage the lid body to an open end of the associated drinking container. The sealing member includes an annular flange sealingly engaging the inner surface. The flange includes at least one groove having an open end in communication with the vent hole and a closed end.

The sealing member is adapted such that suction applied to the mouthpiece in the open position causes ambient air to flow through the vent hole and collect in the at least one groove. The flange is adapted to maintain sealed engagement with the inner surface until air pressure in the at least one groove exceeds a predetermined pressure. When the air pressure exceeds the predetermined air pressure, the flange at least partially separates from the inner surface at a location of the at least one groove allowing ambient air flowing into the vent hole to enter an interior of the associated drinking container as fluid flows out of the associated drinking container through the mouthpiece.

DETAILED DESCRIPTION

It should, of course, be understood that the description and drawings herein are merely illustrative and that various modifications and changes can be made in the structures disclosed without departing from the present disclosure. For purposes of description herein, spatially relative terms, such as "upper" and "lower" and the like, may be used to describe an element and/or feature's relationship to another element(s) and/or feature(s) as, for example, illustrated in the figures of the present disclosure. Moreover, any term of degree used herein, such as "substantially," means a reasonable amount of deviation of the modified word is contemplated such that the end result is not significantly changed.

Figure 1:
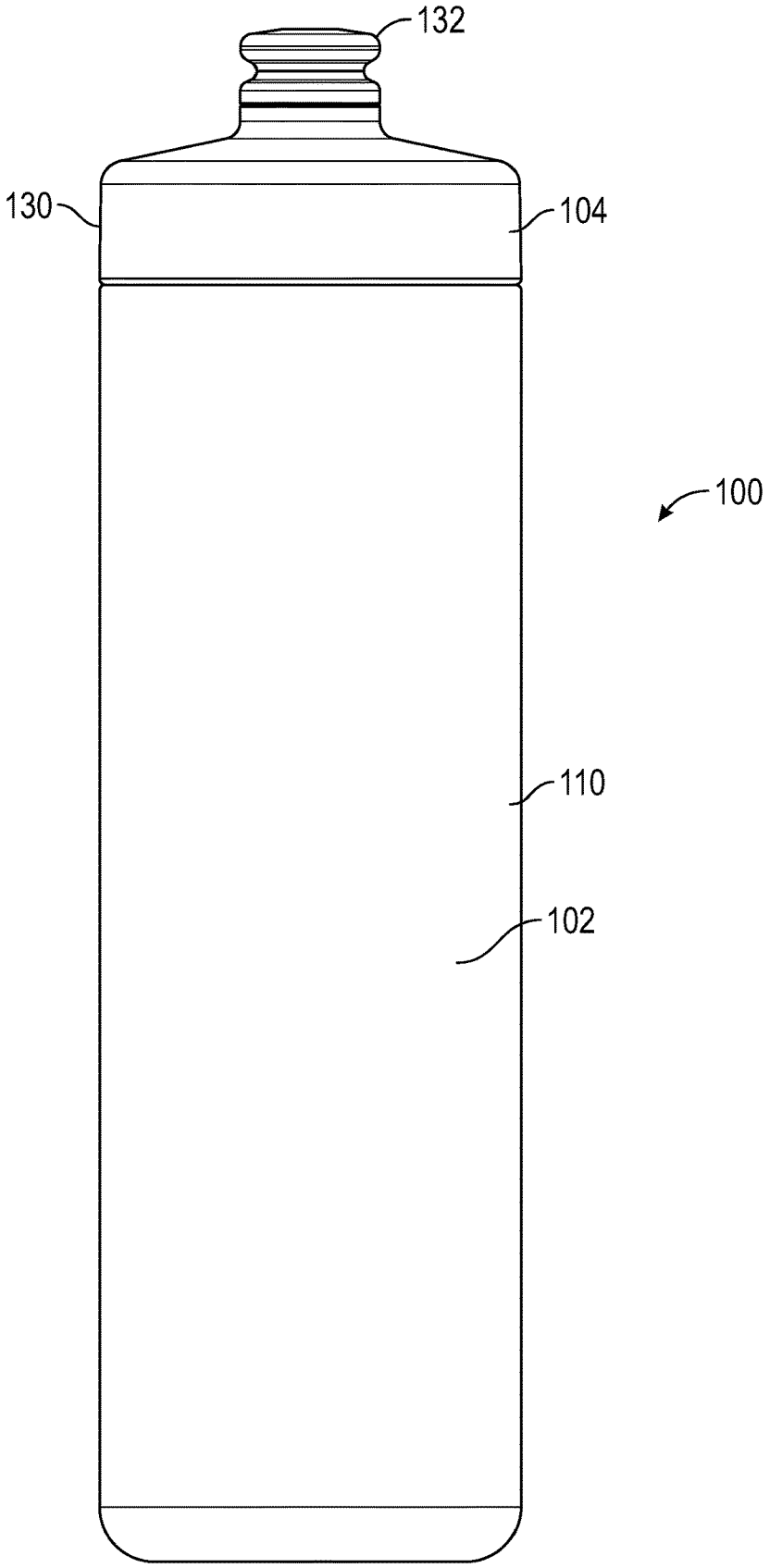
FIG. 1 is a view of a poppet lid according to the present disclosure secured onto an open end or mouth of a drinking container.

Referring now to the drawings, wherein like numerals refer to like parts throughout the several views, FIG. 1 illustrates a container assembly 100 comprising a drink container 102 and an exemplary lid 104 according to the present disclosure which is complementary to the container. In one aspect of the disclosure, the container 102 is configured to be used as a beverage or fluid container, and may correspond to or resemble a bottle, jug, growler, vessel, carafe, or similar beverage container. The container 102 may be fashioned from any material having the desired properties for a beverage container, such as a stainless steel or a plastic formulation (e.g., a thermoplastic, or a thermosetting polymer). In one aspect of the disclosure, the container 102 may incorporate a known double-walled construction, with the intervening space between the walls being substantially evacuated, so that the container is a vacuum-insulated container 102.

In FIGS. 1 and 8-10, the drink container 102 includes body portion 110 and a neck portion 112 having an open end or mouth 114 that provides access to an interior 118 of the container 102. The lid 104 is transitionable between an attached and a detached configuration with respect to the container neck portion 112. The lid 104 (which may alternatively be referred to as a closure or cap) may include one or more suitable structures and components configured so as to provide a sealing arrangement for the mouth 114 of the container 102. By way of example, the lid 104 may include a first securing element (i.e., a first threading 120) that is complementary to a second securing element (i.e., a second threading 122) disposed on the neck portion 112. That is, the first threading may be configured to mate with the second threading, so that the lid 104 may be secured to the neck portion 112 and thereby secured to and against mouth 114. It should be appreciated that additional and/or alternative configurations of securing elements may be used to secure the lid 104 against the container 102, for example, a snap-fit or crimped rim. In such cases the lid 104 and neck portion 112 of the container 102 need not be circular. When the lid 104 is secured to the container 102, the contents of the container assembly 100 are not prone to leaking during routine handling and/or transport.

Figure 2:
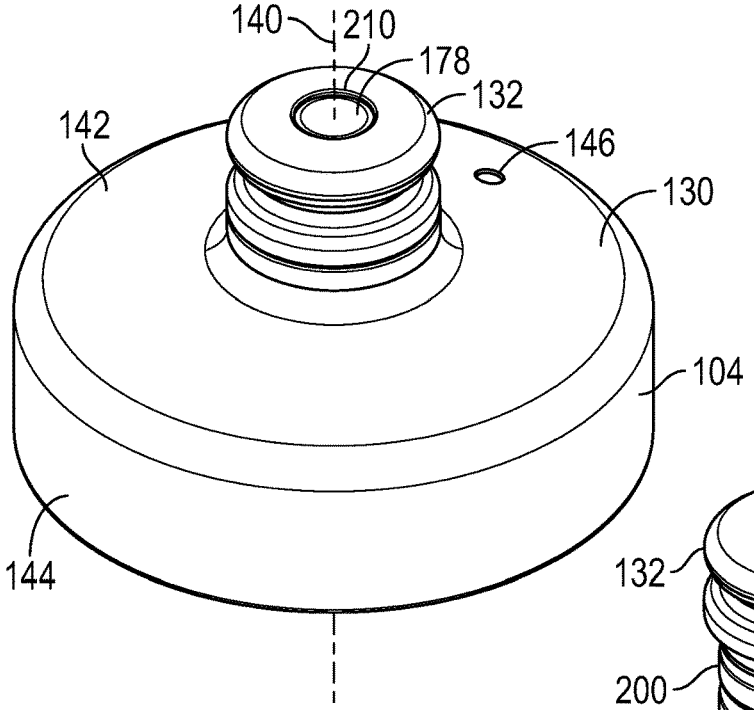
FIG. 2 is a perspective view of the lid.
Figure 3:
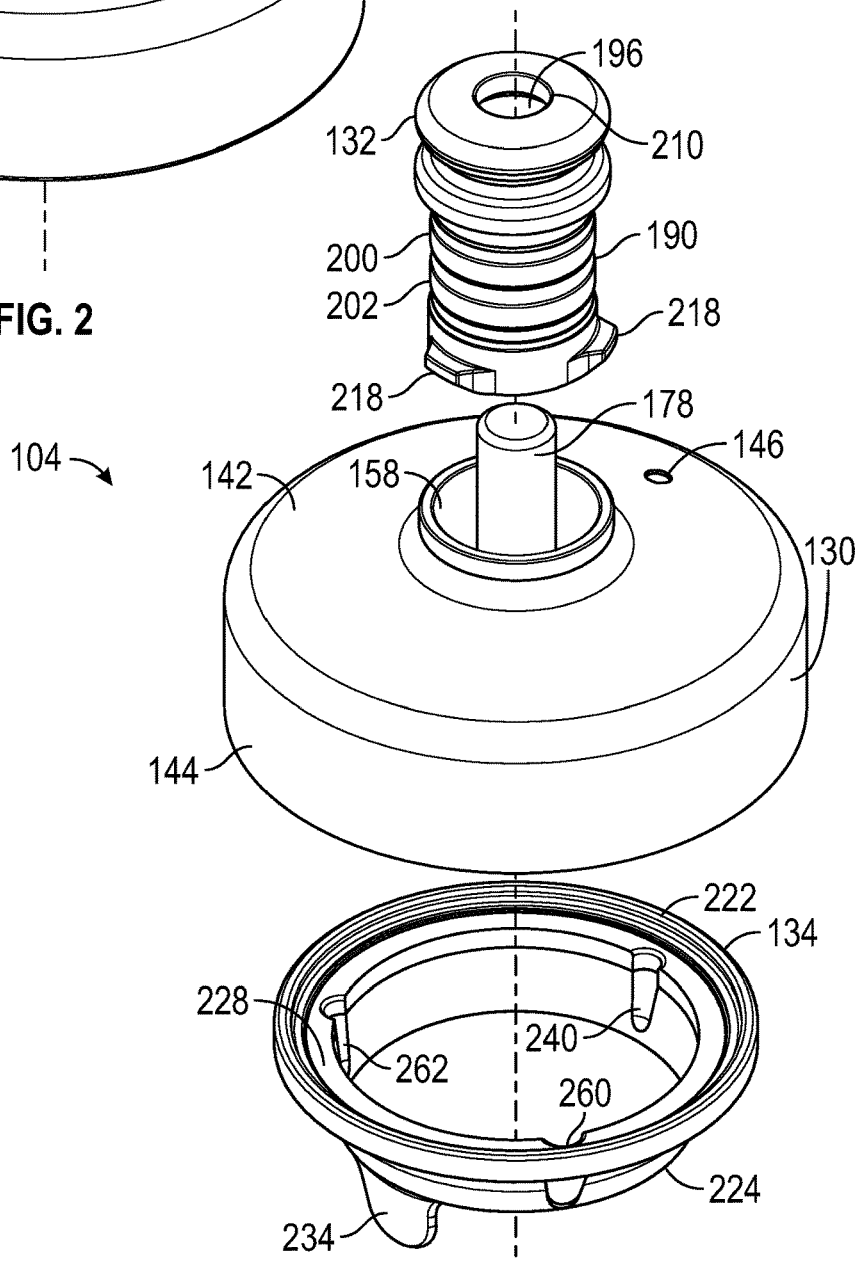
FIG. 3 is an exploded view of the lid, showing a lid body, a poppet mouthpiece and a resilient sealing member.
Figure 4:
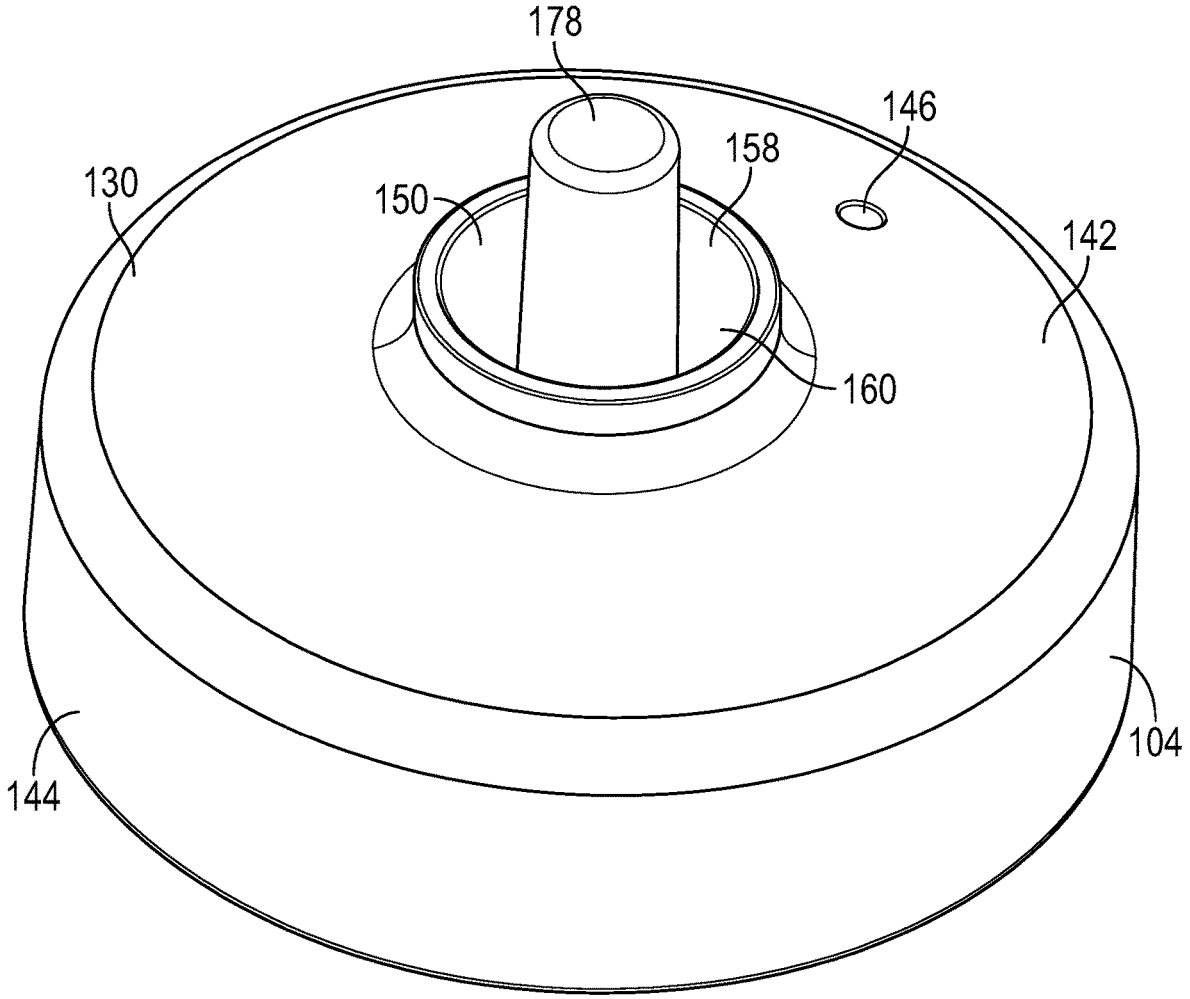
FIGS. 4 and 5 are perspective views of the lid body.
Figure 5:
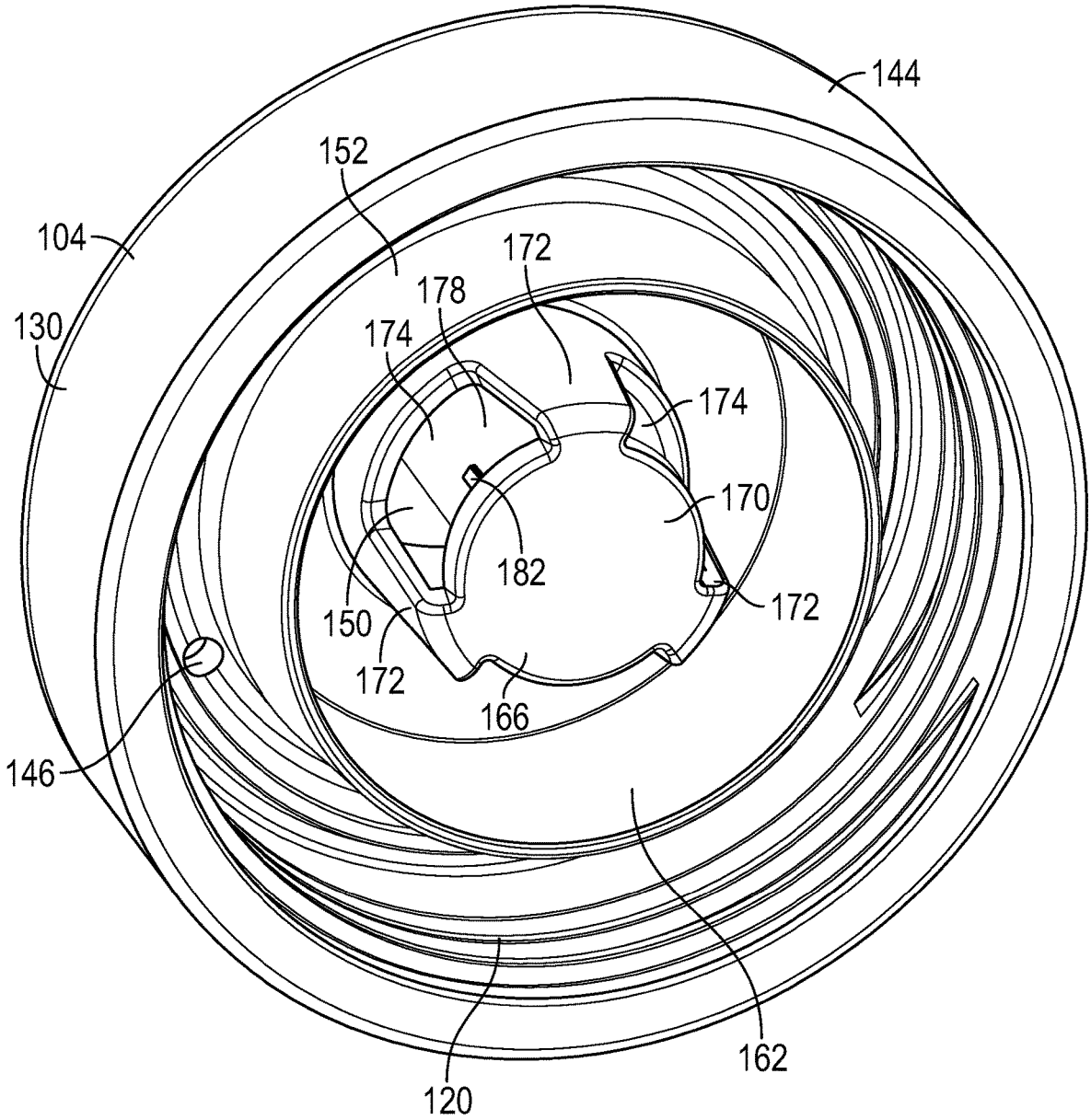

With reference to FIGS. 2 and 3, the exemplary lid 104 includes a lid body 130, a mouthpiece 132 fitted onto the lid body 130 and movable between a closed position and an open position relative to the lid body 130, and a resilient sealing member 134 fitted on the lid body 130 and adapted to sealingly engage the lid body to the open end or mouth 114 of the drinking container 102. In the depicted aspect, the mouthpiece 132 is configured as a poppet mouthpiece, and further description of the lid 104 herein will relate to the poppet mouthpiece. However, it should be appreciated that the mouthpiece 132 of the lid 104 can have other variations that cooperate with the sealing member 134 without departing from the scope of the present disclosure.

As shown in FIGS. 2-5, the lid body 130 defines a longitudinal axis 140 and includes an outer surface and an inner surface. More particularly, the lid body 130 includes an upper or top wall 142 and an outer side wall or skirt 144 extending downwardly from the top wall 142. The upper wall 142 includes a vent hole 146 which allows for the flow of ambient air into the lid body 130. The skirt 144 is cylindrical in configuration in the illustrated embodiment. The skirt 144 includes the first threading 120 for threading onto the complementary second threading 122 located on the container neck 112. The inner surface of the lid body 130 includes a first inner surface 150 and a second inner surface 152. In the depicted aspect, the first inner surface 150 of the lid body 130 is defined by a first inner sleeve 158 having a central opening 160 that receives the mouthpiece 132. The second inner surface 152 of the lid body 130 is defined by a second inner sleeve 162 spaced outwardly from the first inner sleeve 158. To secure the mouthpiece 132 within the central opening 160, the lid body 130 includes a mounting structure 166 connected to and depending from the first inner sleeve 158. In the depicted aspect, with the poppet mouthpiece 132 the mounting structure 166 includes a platform 170 and arms 172 connecting the platform to the first inner sleeve 158. The arms 172 are circumferentially spaced relative to the longitudinal axis 140 to define gaps 174 between adjacent arms that cooperate with features on the mouthpiece 132 to guide linear movement of the mouthpiece 132 relative to the lid body 130. A post 178 for mounting the mouthpiece 132 within the opening 160 of the first inner sleeve 158 extends from the platform, an end portion of the post projects outwardly from the opening 160 of the first inner sleeve 158. A lower end portion of the post 178 adjacent the platform 170 can include strengthening ribs 182 extended in the direction of the longitudinal axis 140.

Figure 8:
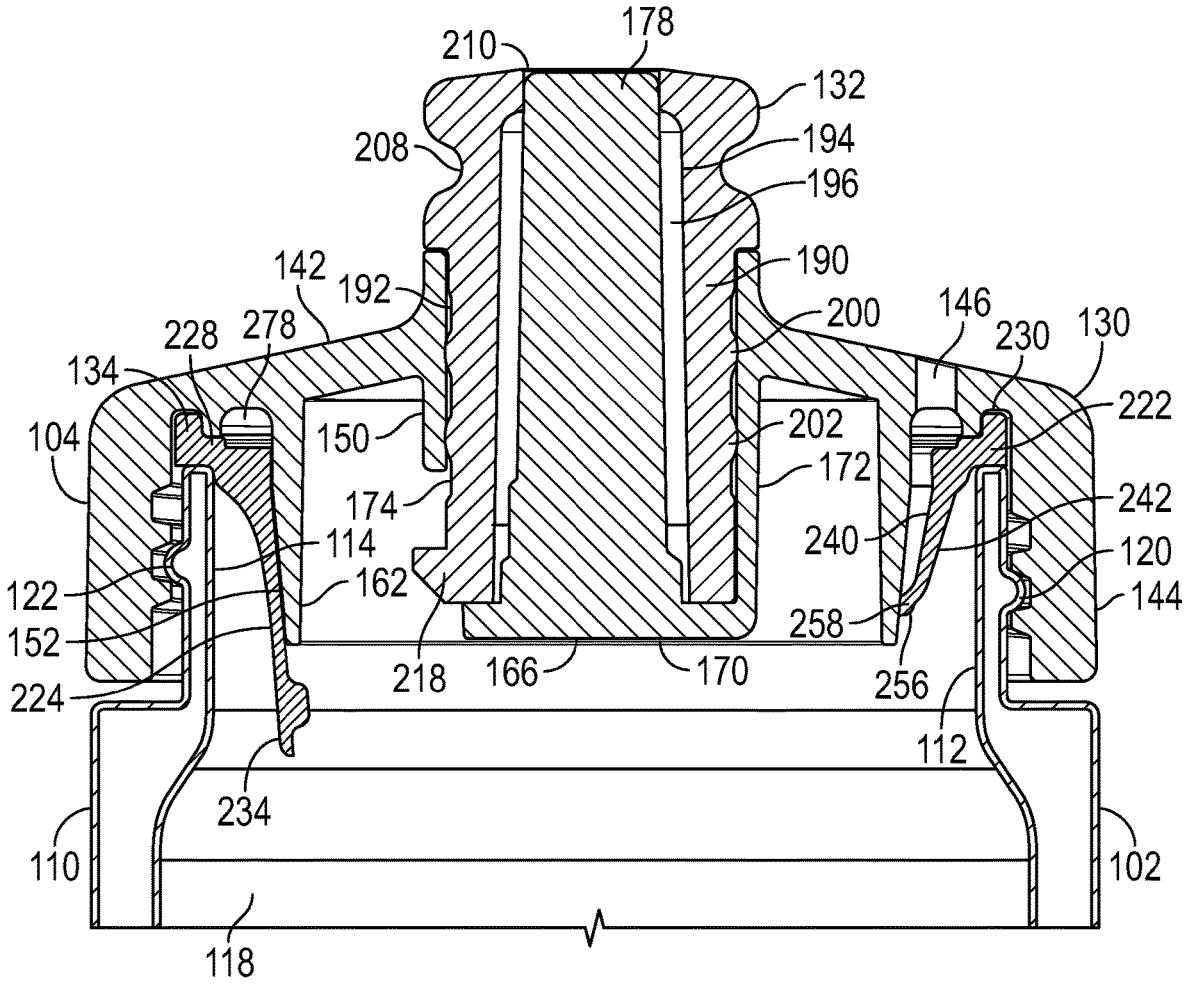
FIG. 8 is a partial cross-sectional view of the lid and container showing the mouthpiece in a closed position.

As indicated, the mouthpiece 132 is movable on the post 178 along the longitudinal axis 140 between the closed position (FIG. 8) and the open position (FIGS. 9 and 10) relative to the lid body 130. As shown in FIGS. 3 and 8, the mouthpiece 132 includes a body 190 having an exterior surface 192 and an interior surface 194 that defines an interior passage 196 that extends all the way through the body 190. The passage 196 is sized to the receive the post 178 of the lid 104. The mouthpiece 132 seals against the first inner surface 150 (i.e., the first inner sleeve 158) of the lid body 130 via at least one annular seal ring 200 provided on the exterior surface 192. In the depicted aspect, the seal ring 200 is an upper seal ring positioned adjacent a mid-portion of the body 190, and the mouthpiece includes a lower seal ring 202 positioned adjacent a lower end of the body 190 of the mouthpiece 132. An upper end portion of the body 190 of the mouthpiece 132 can includes a circumferential groove 208, which may facilitate grasping and/or moving the mouthpiece between the closed and open positions. In the closed position of the mouthpiece, the post 178 is sealingly received in an opening 210 to prevent fluid from inside the drinking container 102 to flow through the mouthpiece passage 196 and the lower end of the body 190 is rested on the platform 170 (see FIG. 8). In the open position the mouthpiece 132 allows fluid from inside the drinking container to flow through the mouthpiece passage 196 (see FIG. 9). To prevent the mouthpiece 132 from moving past the open position, the mouthpiece include retention tabs 218 positioned in the gaps 174 between adjacent arms 172 of the mounting structure 166. The retention tabs 218 are dimensioned to slide within the gaps 174 to guide the mouthpiece 132 between the closed and open positions. Each retention tab 218 engages a lower edge of the first inner sleeve 158 in the open position of the mouthpiece 132.

Figure 6:
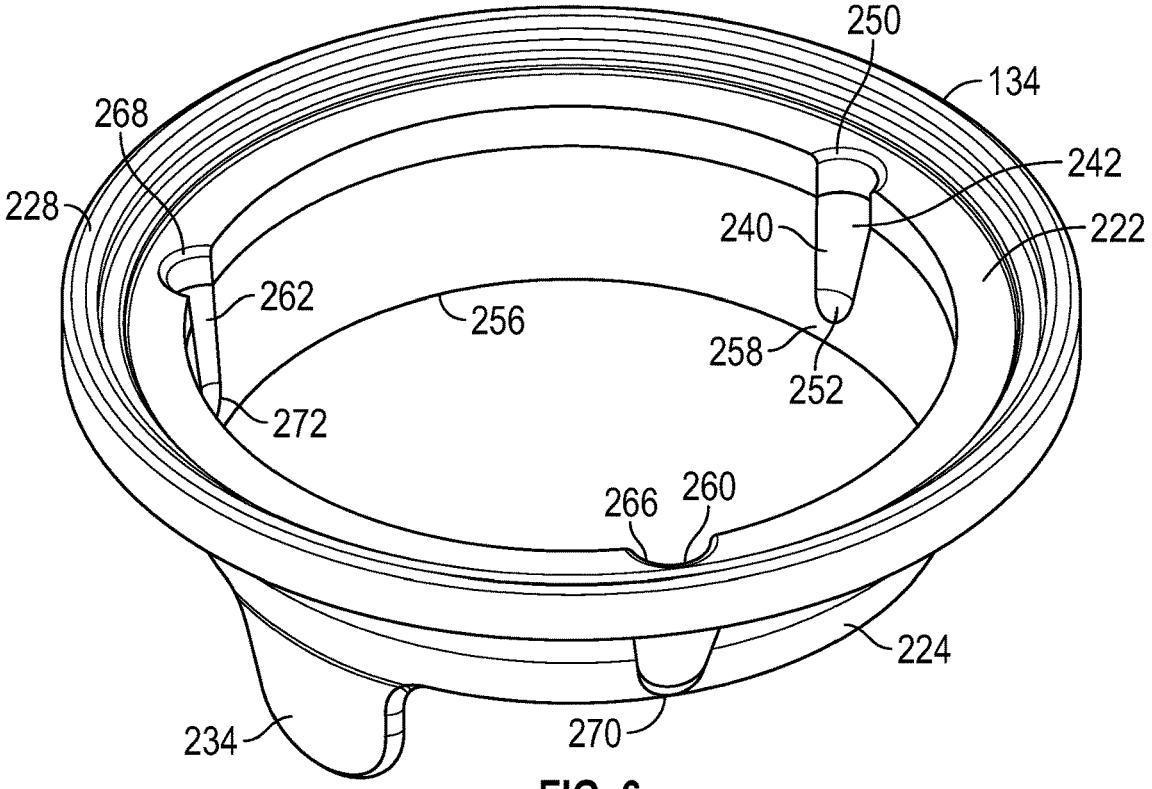
FIG. 6 is a perspective view of the sealing member.
Figure 7:
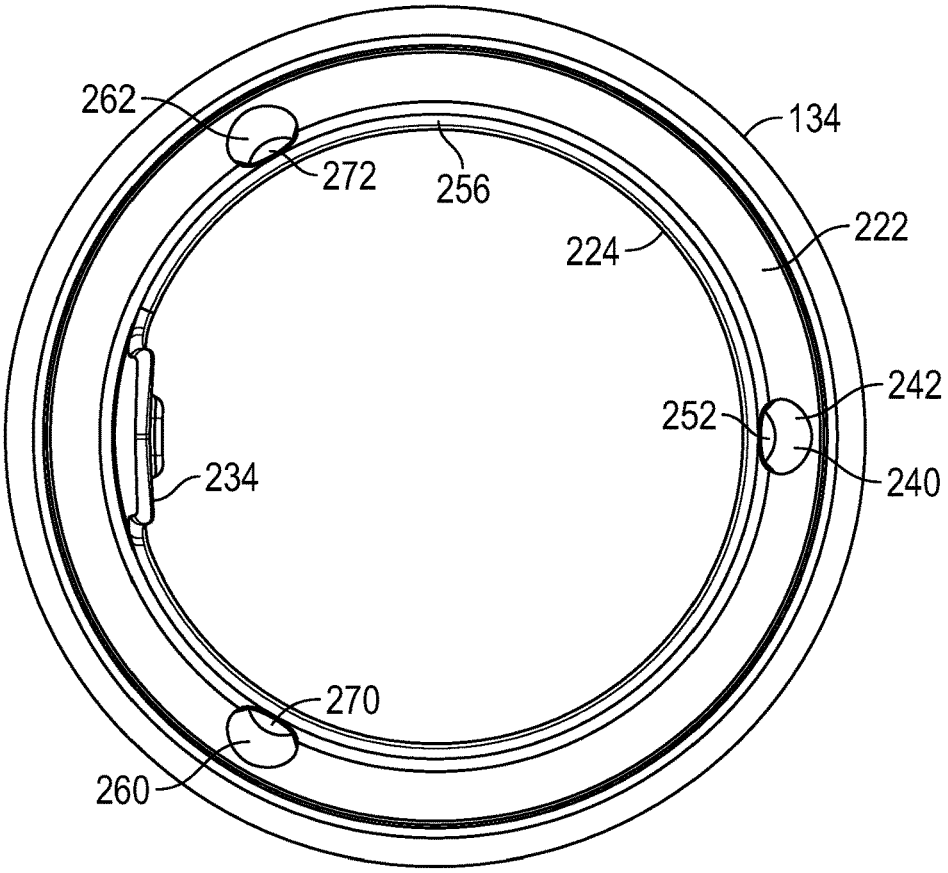
FIG. 7 is a bottom plan view of the sealing member.
Figure 9:
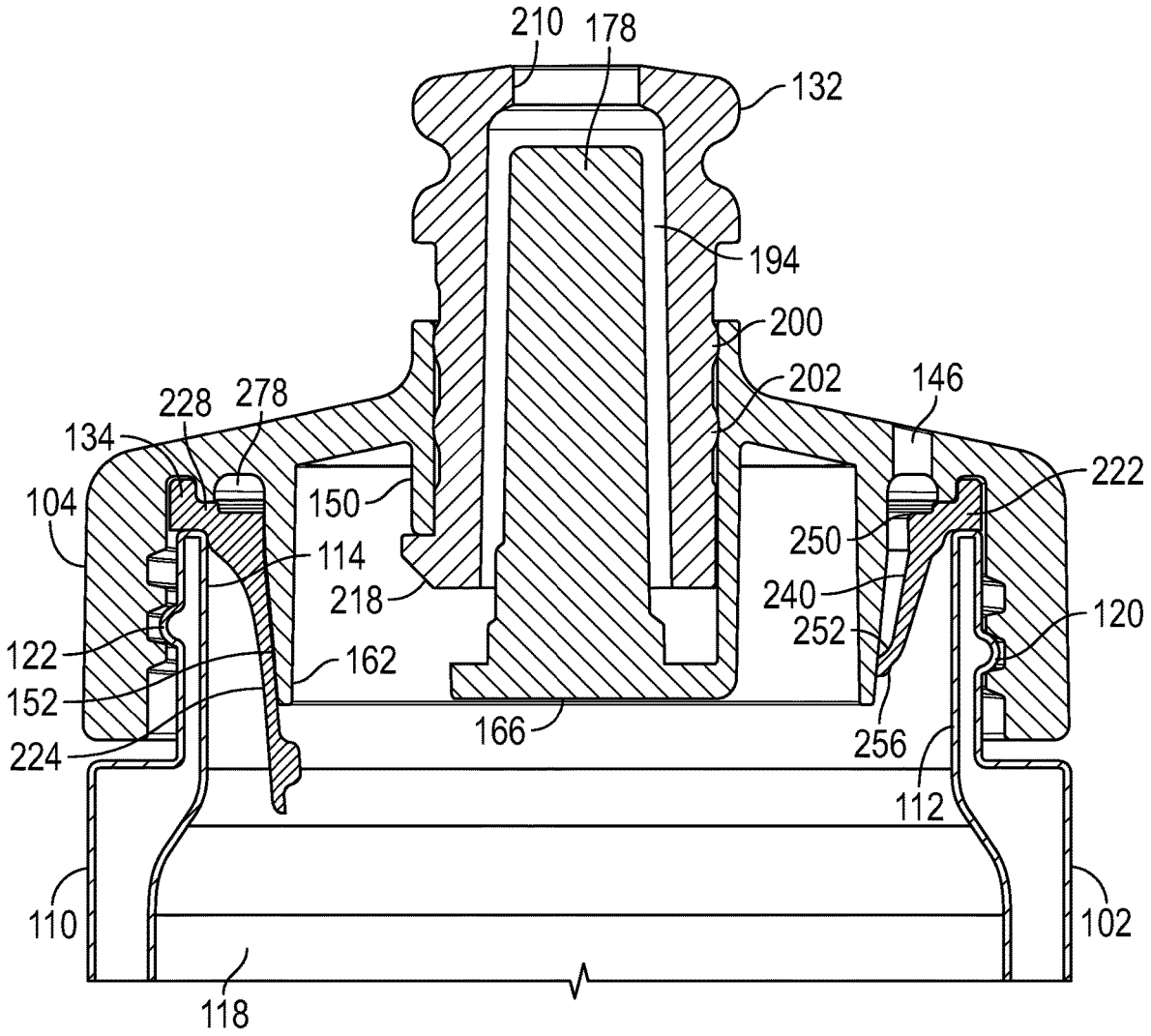
FIG. 9 is a partial cross-sectional view of the lid and container showing the mouthpiece in an open position, with a flange of the sealing member sealingly engaged to an inner surface of the lid body.
Figure 10:
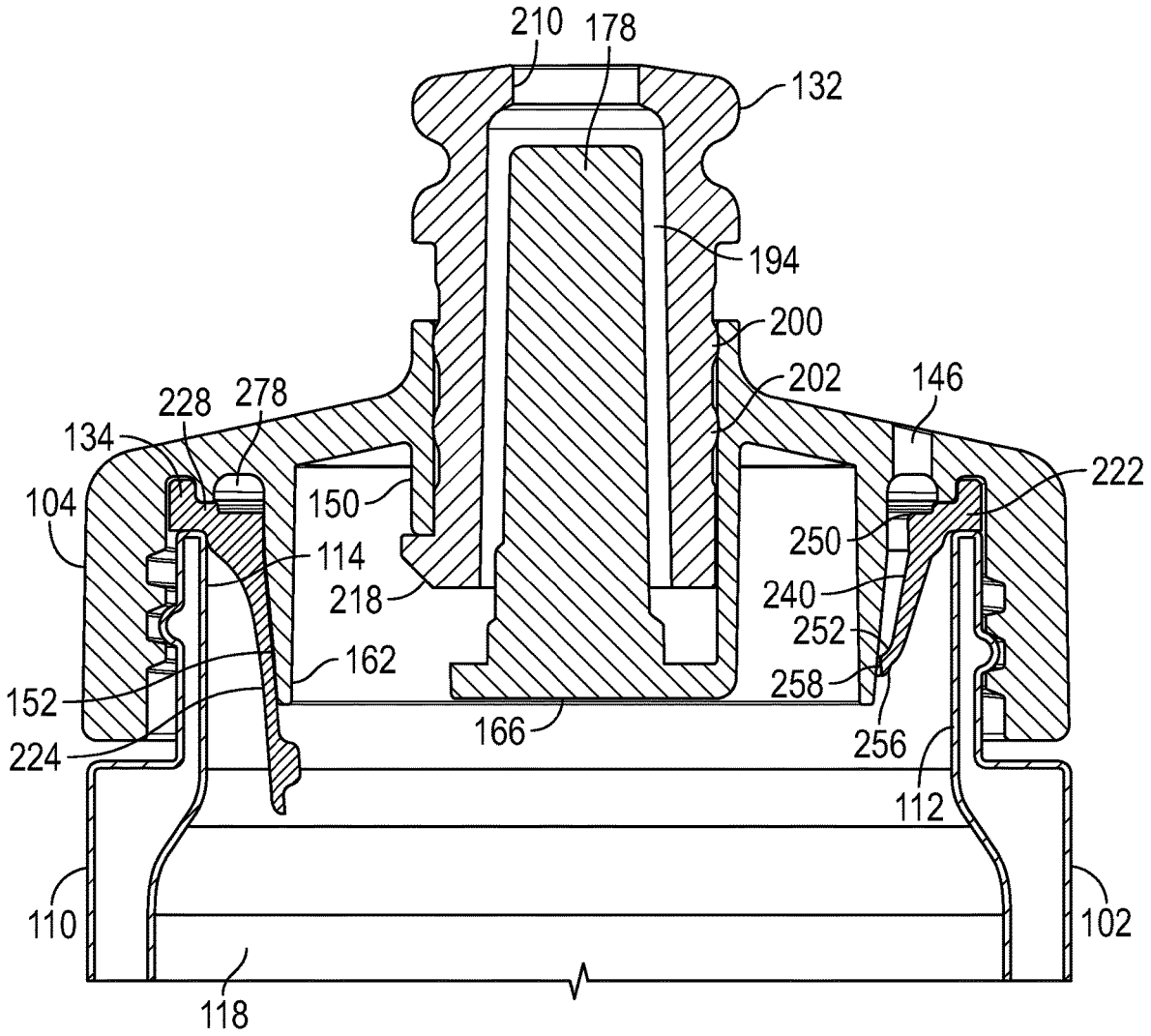
FIG. 10 is a partial cross-sectional view of the lid and container showing the mouthpiece in the open position, with the flange of the sealing member sealingly engaged to the inner surface of the lid body except at a location of a groove of the sealing member, the groove allowing ambient air flowing into a vent hole of the lid body to enter an interior of the container as fluid flows out of the container through the mouthpiece.

In FIGS. 8-10, the resilient sealing member 134 is fitted on the lid body 130 and adapted to sealingly engage the lid body to the open end or mouth 114 of the drinking container 102. With additional reference to FIGS. 6 and 7, the sealing member 134 includes a sealing body 222 and a flange 224, each being annular in shape to correspond to the shape of the lid body 130. The sealing body 222 is mounted to the lid body 130 between the side wall or skirt 144 and the second inner surface 152 (i.e., second inner sleeve 162) for sealingly engaging the container mouth 114. In the depicted aspect, the sealing body 222 includes an annular stepped section 228 that is fitted into a recessed portion 230 of the lid body 130, with an inner surface of the stepped section 228 sealingly engaged to the second inner surface 152. The flange 224 depends from the sealing body 222, specifically the stepped section 228, for also sealingly engaging the second inner surface 152 of the lid body 130. A gripping tab 234 can depend from the flange 224 to allow for easy removal of the sealing member from the lid body.

As indicated, when fluid is withdrawn from the container 102, through the mouthpiece 132, a negative pressure may be created within the container, thus making it more difficult to further withdraw liquid. To address this problem, the flange 224 includes at least one groove 240 extended in a direction substantially parallel to the longitudinal axis. As depicted, because the flange 224 is substantially wedge shaped in a cross-section taken along the longitudinal axis, the at least one groove 240 is defined by a bulge section 242 formed on the flange; although, this is not required. The at least one groove 240 defines a predetermined location on the lid 104 where ambient air flowing into the vent hole 146 can enter the interior 118 of the container 102 as fluid flows out of the container through the mouthpiece 132 in the open position.

In the present aspect, the at least one groove 240 is extended onto the sealing body 222 with an opening or open end 250 of the at least one groove provided on the sealing body and in communication with the vent hole 146. The at least one groove 240 includes a closed second end 252 offset from a lower edge 256 of the flange 224 such that a section 258 of the flange 224 extended beneath the closed second end 252 of the at least one groove 240 is sealing engaged to the second inner surface 152 of the lid body 130. According to the present disclosure, the at least one groove 240 is a first groove 240, and the sealing member 134 includes a second groove 260 circumferentially spaced relative to the longitudinal axis from the first groove and a third groove 262 circumferentially spaced relative to the longitudinal axis from the first groove 240 and the second groove 260. Each of the first and second grooves is shaped similar to the first groove 240 and includes a respective open first end 266, 268 in communication with the vent hole 146 and a respective closed second end 270, 272 offset from the lower edge 256. Further, the sealing member 134 is configured such that the stepped section 228, together with the upper wall 142 of the lid body 130, defines an air pathway 278 from the vent hole 146 toward the open end of each groove.

According to the present disclosure, the sealing member 134 is configured such that suction applied to the mouthpiece 132 in the open position causes ambient air to flow through the vent hole 146 along the air pathway 278 and into each groove where the air is collected. In FIG. 9, the flange 224, particularly the section 258 of the flange between each closed end of each groove and the lower edge 256, is adapted to maintain sealed engagement with the second inner surface 152 until air pressure in at least one of the grooves (e.g., depicted first groove 240) exceeds a predetermined air pressure. It should be appreciated that the phrase "predetermined air pressure" means a maximum interior air pressure sustainable within each flange groove prior to separation of the flange 224 from the second inner surface 152 that is established in the manufacture of the sealing member 134. When the air pressure in at least one of the grooves (e.g., depicted first groove 240) exceeds the predetermined air pressure, the section 258 of the flange 224 at least partially separates (i.e., breaks the seal) from the second inner surface 152 at the location of the at least one groove. This separation of the flange section 258 at the first groove 240 is shown in FIG. 10, and the separation is maintained while suction is continually applied at the mouthpiece 132. The separation of the flange section 258 from the second inner surface 152 allows the collected air within the at least one groove to flow into the open end or mouth 114 of the container 102, thereby further allowing ambient air flowing into the vent hole 146 to enter the 118 interior of the container 102 as fluid flows out of the container through the mouthpiece 132 in the open position. It should be appreciated that when suction stops, the flange 224 returns to its sealed state with the second inner surface 152 of the lid body 130.

It will be appreciated that the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A lid for an associated drinking container comprising:

a lid body defining a longitudinal axis, the lid body includes an outer surface with a vent hole;

a poppet mouthpiece at least partially received within the lid body and that seals against a first inner surface of the lid body via at least one annular seal ring provided on the mouthpiece, the mouthpiece movable along the longitudinal axis between a closed position and an open position relative to the lid body, when in the open position the mouthpiece allows fluid from inside the associated drinking container to flow through the mouthpiece; and a resilient sealing member fitted on the lid body and adapted to sealingly engage the lid body to an open end of the associated drinking container, the sealing member includes an annular flange sealingly engaging a second inner surface of the lid body, the flange includes at least one groove extended in a direction substantially parallel to the longitudinal axis, the at least one groove defines a predetermined location on the lid where ambient air flowing into the vent hole can flow through the at least one groove and enter an interior of the associated drinking container as fluid flows out of the associated drinking container through the mouthpiece in the open position, wherein the sealing member includes an annular sealing body mounted to the lid body for sealingly engaging the open end of the associated drinking container, the flange depends from the sealing body.

2. The lid of claim 1, wherein the at least one groove is extended onto the sealing body with an opening of the at least one groove provided on the sealing body.

3. The lid of claim 2, wherein the sealing body includes an annular stepped section which at least partially defines an air pathway from the vent hole toward the opening of the at least one groove.

4. The lid of claim 3, wherein the air pathway is further defined by an upper wall of the lid body.

5. The lid of claim 3, wherein the flange depends from the stepped section, and in a cross-section taken along the longitudinal axis the flange is substantially wedge shaped.

6. The lid of claim 1, wherein the at least one groove includes a first groove and a second groove circumferentially spaced relative to the longitudinal axis from the first groove, each of the first and second grooves includes an open first end in airflow communication with the vent hole and a closed second end, a section of the flange is extended beneath the closed second end and is sealing engaged to the second inner surface of the lid body.

7. The lid of claim 6, wherein the at least one groove further includes a third groove circumferentially spaced relative to the longitudinal axis from the first groove and the second groove, wherein the sealing member is adapted such that suction applied to the mouthpiece in the open position causes ambient air to flow through the vent hole and collect in each groove, the flange is adapted to maintain sealed engagement with the second inner surface until air pressure in at least one of the grooves exceeds a predetermined pressure wherein the flange at least partially separates from the second inner surface at the location of the at least one groove allowing ambient air flowing into the vent hole to enter an interior of the associated drinking container as fluid flows out of the associated drinking container through the mouthpiece.

8. The lid of claim 1, wherein the at least one groove is defined by a bulge section formed on the flange.

9. The lid of claim 1, wherein the first inner surface of the lid body is defined by a first inner sleeve, and the lid body includes a mounting structure for the mouthpiece connected to the first inner sleeve.

10. The lid of claim 9, wherein the mounting structure includes a platform and arms connecting the platform to the first inner sleeve, a post for mounting the mouthpiece extends outwardly from the platform, and the mouthpiece includes retention tabs positioned between adjacent arms.

11. The lid of claim 10, wherein the second inner surface of the lid body is defined by a second inner sleeve spaced outwardly from the first inner sleeve.

12. A lid for an associated drinking container comprising:

a lid body defining a longitudinal axis, the lid body includes an upper wall with a vent hole, an outer side wall extending downwardly from the upper wall, and an inner surface;

a mouthpiece movable between a closed position and an open position relative to the lid body, when in the open position the mouthpiece allows fluid from inside the associated drinking container to flow through the mouthpiece; and a resilient sealing member fitted on the lid body, the sealing member adapted to sealingly engage the lid body to an open end of the associated drinking container, the sealing member includes an annular flange sealingly engaging the inner surface, the flange includes at least one groove having an open end in airflow communication with the vent hole and a closed end, wherein the sealing member is adapted such that suction applied to the mouthpiece in the open position causes ambient air to flow through the vent hole and collect in the at least one groove, the flange is adapted to maintain sealed engagement with the inner surface until air pressure in the at least one groove exceeds a predetermined pressure wherein the flange at least partially separates from the inner surface at a location of the at least one groove allowing ambient air flowing into the vent hole to enter an interior of the associated drinking container as fluid flows out of the associated drinking container through the mouthpiece, wherein the at least one groove includes a first groove and a second groove circumferentially spaced relative to the longitudinal axis from the first groove, each of the first and second grooves has an open end in airflow communication with the vent hole and a closed end, and each of the first and second grooves defines a predetermined location on the lid where ambient air flowing into the vent hole can enter the interior of the associated drinking container as fluid flows out of the associated drinking container through the mouthpiece in the open position.

13. The lid of claim 12, wherein a section of the flange is extended beneath the closed end and is sealingly engaged to the inner surface of the lid body.

14. The lid of claim 12, wherein the sealing member includes an annular sealing body mounted to the lid body for sealingly engaging the open end of the associated drinking container, the flange depends from the sealing body.

15. The lid of claim 14, wherein the sealing body includes an annular stepped section which together with the lid body defines an air pathway from the vent hole toward the open end of the at least one groove.

16. The lid of claim 12, wherein the mouthpiece is configured as a poppet mouthpiece that seals against the inner surface via at least one annular seal ring provided on the poppet mouthpiece, the poppet mouthpiece movable along the longitudinal axis between the closed position and the open position relative to the lid body.

17. The lid of claim 16, wherein the inner surface of the lid body includes a first inner surface and a second inner surface spaced outwardly from the first inner surface, the poppet mouthpiece seals against the first inner surface, and the sealing member is fitted on the lid body between the outer side wall and the second inner surface with the flange of the sealing member sealingly engaging the second inner surface.

18. A lid for an associated drinking container comprising:

a lid body defining a longitudinal axis, the lid body includes an outer surface with a vent hole;

a poppet mouthpiece that seals against a first inner surface of the lid body via at least one annular seal ring provided on the mouthpiece, the mouthpiece movable along the longitudinal axis between a closed position and an open position relative to the lid body, when in the open position the mouthpiece allows fluid from inside the associated drinking container to flow through the mouthpiece; and a resilient sealing member fitted on the lid body and adapted to sealingly engage the lid body to an open end of the associated drinking container, the sealing member includes an annular flange sealingly engaging a second inner surface of the lid body, the flange includes at least one groove extended in a direction substantially parallel to the longitudinal axis, the at least one groove defines a predetermined location on the lid where ambient air flowing into the vent hole can enter an interior of the associated drinking container as fluid flows out of the associated drinking container through the mouthpiece in the open position, wherein the at least one groove includes a first groove and a second groove circumferentially spaced relative to the longitudinal axis from the first groove, each of the first and second grooves includes an open first end in airflow communication with the vent hole and a closed second end, a section of the flange is extended beneath the closed second end and is sealing engaged to the second inner surface of the lid body.

* * * * *